US007252177B2

(12) United States Patent
Minato

(10) Patent No.: US 7,252,177 B2
(45) Date of Patent: Aug. 7, 2007

(54) EXHAUST SYSTEM FOR ENGINE

(75) Inventor: Tsukasa Minato, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 226 days.

(21) Appl. No.: 10/997,879

(22) Filed: Nov. 29, 2004

(65) Prior Publication Data

US 2005/0115765 A1 Jun. 2, 2005

(30) Foreign Application Priority Data

Dec. 2, 2003 (JP) ..... 2003-403302

(51) Int. Cl.
*F01N 7/08* (2006.01)
*F01N 7/10* (2006.01)
*F16L 39/00* (2006.01)

(52) U.S. Cl. ..... 181/240; 60/313; 60/324; 60/323

(58) Field of Classification Search ..... 181/240, 181/238; 60/313, 323; 29/890.08
See application file for complete search history.

(56) References Cited

U.S. PATENT DOCUMENTS 4,796,426 A * 1/1989 Feuling ..... 60/313
4,815,274 A * 3/1989 Piatti ..... 60/313
6,105,717 A * 8/2000 Kleukers ..... 181/282
6,360,782 B1 * 3/2002 Yoshitoshi et al. ..... 138/115
6,702,062 B2 * 3/2004 Kusabiraki et al. ..... 181/240
6,722,126 B2 * 4/2004 Kawamizu ..... 60/324

FOREIGN PATENT DOCUMENTS

JP 2001-55920 A 2/2001

* cited by examiner

*Primary Examiner*—Lincoln Donovan
*Assistant Examiner*—Forrest Phillips
(74) *Attorney, Agent, or Firm*—Foley & Lardner LLP

(57) ABSTRACT

An exhaust manifold has a structure such that an end portion of a collecting section where pipes connected to respective cylinders of an engine are collected is connected to an exhaust pipe via a joint tube member. The joint tube member is constituted by an upper joint portion and a lower joint portion, and cut-out grooves are formed on both joining portions of the upper joint portion or the lower joint portion. With the cut-out grooves, a partition plate is engaged to be positioned, and in this state, the partition plate is fixed to the upper joint portion or the lower joint portion.

5 Claims, 12 Drawing Sheets

EXHAUST SYSTEM FOR ENGINE

BACKGROUND OF THE INVENTION

1. Field of the Invention

The present invention relates to an exhaust system for an engine that includes an exhaust manifold having a structure such that an end portion of a collecting section where pipes connected to respective cylinders of an engine are collected is inserted and fixed in an upstream side end portion of a joint tube member by which the exhaust manifold and an exhaust pipe are connected with each other.

2. Description of the Related Art

A conventional exhaust system for an engine is disclosed in Japanese Patent Application Laid-open No. 2001-055920. As shown in FIG. 8, this conventional exhaust system has an exhaust manifold that has a structure such that a pipe end of a collecting section 105 where pipes 101 to 104 connected to respective cylinders, not shown, of an engine are collected is inserted and fixed in an upstream side end portion of a joint tube member 106 having a cylindrical shape to receive the pipe end of a collecting section 105 and an exhaust pipe, not shown.

Further, FIG. 9A shows an enlarged perspective view describing a connection state of the joint tube member 106 and the collecting section 105 before assembling, and FIG. 9B shows a perspective view describing a connection state of the conventional joint tube member 106 and the collecting section 105 after assembling. As shown in FIG. 9A and FIG. 9B, the joint tube member 106 is formed in a state that a partition plate 109 is sandwiched between an upper joint part 107 and a lower joint part 108 to form two exhaust passages therein so as to prevent exhaust gas interference outputted from the pipes 101 to 104.

Furthermore, FIG. 10 shows a cross-sectional view taken along the line S10-S10 in FIG. 8. As shown in FIG. 10, between an upstream side end portion of the partition plate 109 and an end portion of the collecting section 105, a clearance W with a predetermined distance is generally provided for allowing a relative displacement of the collecting section 105 and the joint tube member 106 due to their thermal expansion.

However, in the conventional exhaust system, the position of the partition plate 109 is occasionally displaced from an intended position when the upper joint part 107, the lower joint part 108, and the partition plate 109 are fixed by welding in a state that the partition plate 109 is sandwiched between the upper joint part 107 and the lower joint part 108, and thus the partition plate 109 cannot be fixed precisely with respect to the joint tube member 106. Consequently, there has been a problem that the clearance W varies in products.

Incidentally, the clearance W cannot be adjusted or inspected from outside after both of them are assembled, because the end portion of the collecting section 105 is inserted and fixed in the upstream side end portion of the joint tube member 106.

Further, when upstream side end portions of both joining parts 107 and 108 of the upper joint part 107 and the lower joint part 108 are joined in the radial direction, a gap WA is generated as shown in FIG. 9B when the end portion of the collecting section 105 is inserted and fixed in the upstream side end portion. Accordingly, a large welding tip should be used to fill this gap WA, so that a welding work thereof requires much labor and time, and moreover welding sputter may enter inside the joint tube member 106.

The present invention has been made to solve the above-described problems, and an object thereof is to provide an exhaust system that includes an exhaust manifold in which a clearance can be formed appropriately between a partition plate and an end portion of a collecting section by positioning and fixing the partition plate precisely with respect to a joint tube member.

SUMMARY OF THE INVENTION

In an invention according to the present invention, an exhaust system for an engine comprising: an exhaust manifold having a collecting section where pipes connected to respective cylinders of an engine are collected; an exhaust pipe; a cylindrical joint tube member having an upstream side end portion in which an end portion of the collecting section is inserted and fixed and a down stream side end portion in which an end portion of the exhaust pipe is inserted and fixed, the joint tube member being constituted of a first joint part and a second joint part having first joining portions and second joining portions to meet each other, respectively; and a partition plate which partitions the inside of the joint tube member, wherein a clearance is formed between the upstream side end portion of the partition plate and the end portion of the collecting section, wherein cut-out grooves are formed on at least one of the first and second joining portions of the first joint part and the second joint part, and wherein the partition plate is fixed to at least one of the first joint part and the second joint part in a state of being positioned by engaging with the cut-out grooves.

In the exhaust manifold according to the present invention, the cut-out grooves are formed on at least one of the first and second joining portions of the first and the second joint part, and the partition plate is fixed to at least one of the first and the second joint part in a state of being positioned by engaging with the cut-out grooves, so that the partition plate can be easily and precisely fixed with respect to the joint tube member. Accordingly, the clearance between the upstream side end portion of the partition plate and the end portion of the collecting section can be precisely formed.

Preferably, upstream side end portions of both the joining portions of the first joint part and the second joint part are fixed with each other in a state of abutting on each other.

Accordingly, the upstream side end portions of both the joining portions are in a state of abutting on each other, so that an unnecessary gap is not formed between the first and second joining portions and the collecting section, and thus the both of them can be welded by a welding chip with a small diameter. Consequently, the welding work becomes easy, and welding can be performed securely from outside including the partition plate. Therefore, there is no possibility that welding sputter enters inside the joint tube member.

Preferably, the upstream side end portions of the first joint part and the second joint part are fixed with each other by welding.

This can bring the upstream side end portions of the first and the second joints easy fixation therewith, the both of them can be welded by a welding chip with a small diameter and eliminating an unnecessary gap between the first and second joining portions and the collecting section, ensuring seal between them.

Preferably, the first joint part and the second joint part are fixed with the partition plate by welding.

This can bring the first and the second joints easy fixation therewith, ensuring seal between them.

Preferably, the first joint part, the second joint part, and the partition plate are fixed with one another by welding.

This can bring the first and the second joints and the partition plate easy fixation therewith, ensuring seal between them.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Hereinafter, an exhaust manifold according to an embodiment of the present invention will be described based on the attached drawings.

Figure 1:
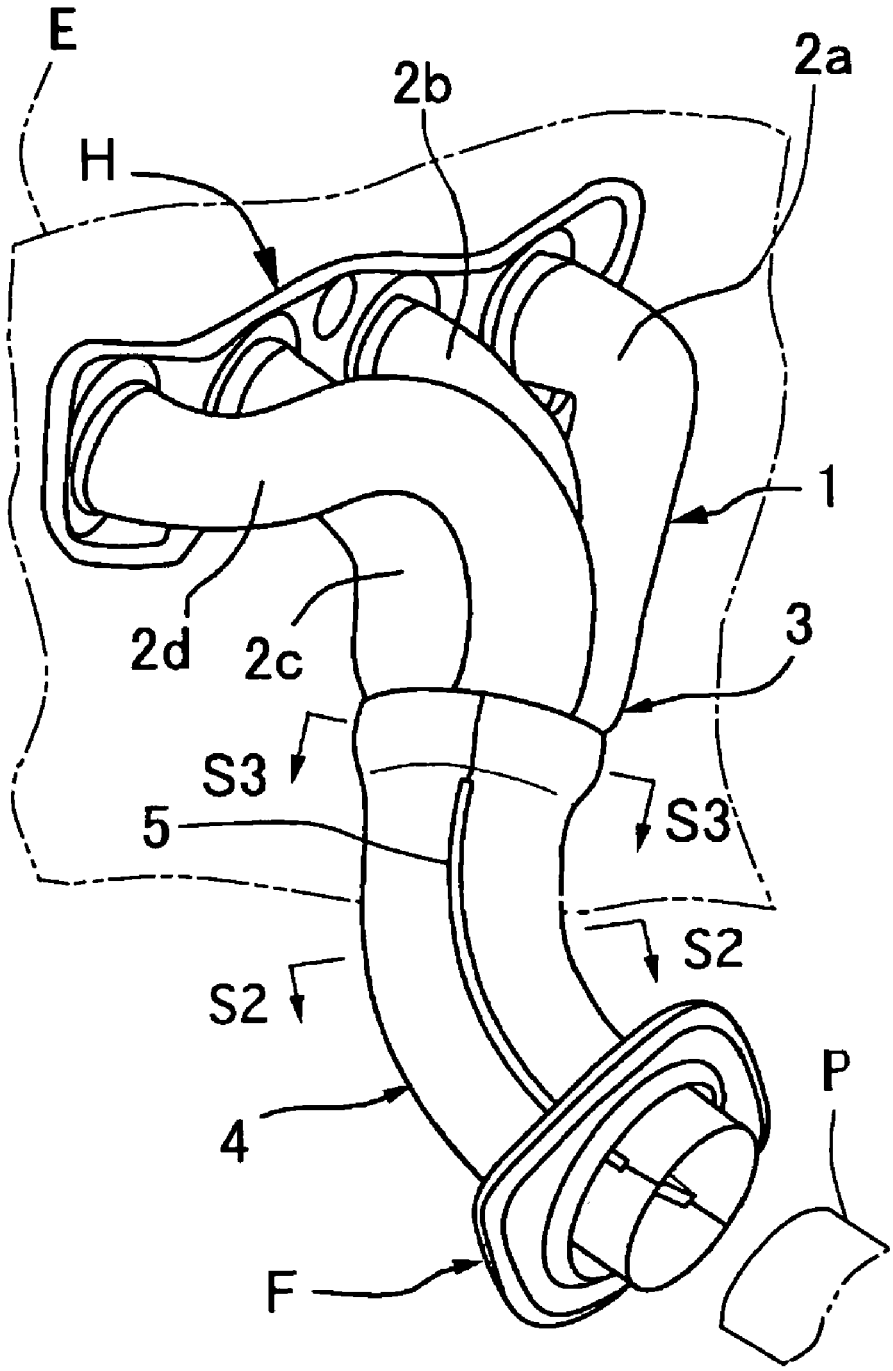
FIG. 1 is an overall view of an exhaust system that includes an exhaust manifold, an exhaust pipe, and a joint tube member according to an embodiment of the present invention.

There is shown in FIG. 1 an exhaust system for a vehicle according to this embodiment of the present invention. The exhaust system includes an exhaust manifold 1, an exhaust pipe P, and a joint tube member 4 connecting the exhaust manifold 1 and the exhaust pipe P.

The exhaust manifold 1 has a structure such that upstream side end portions of four pipes 2*a* to 2*d* are connected to respective cylinders, not shown, of an engine E via a head flange H, and at the same time, downstream side end portions of the respective pipes 2*a* to 2*d* are each formed in a ¼ circular shape and are collected in a circular shape to form a collecting section 3.

Figure 2:
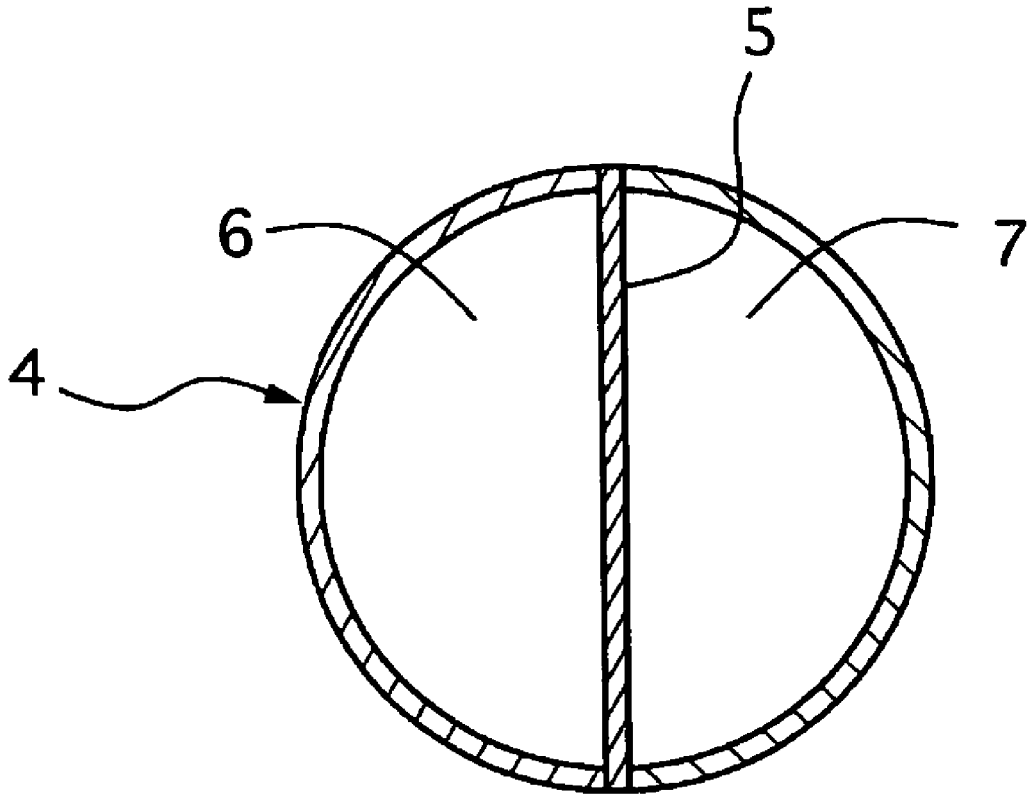
FIG. 2 is an enlarged cross-sectional view taken along the line S2-S2 in FIG. 1.

An end portion of the collecting section 3 is fixed in a state of being inserted in the joint tube member 4 having a cylindrical shape, and the joint tube member 4 is, as shown in FIG. 2, partitioned in two exhaust passages 6, 7 by a partition plate 5.

Figure 3:
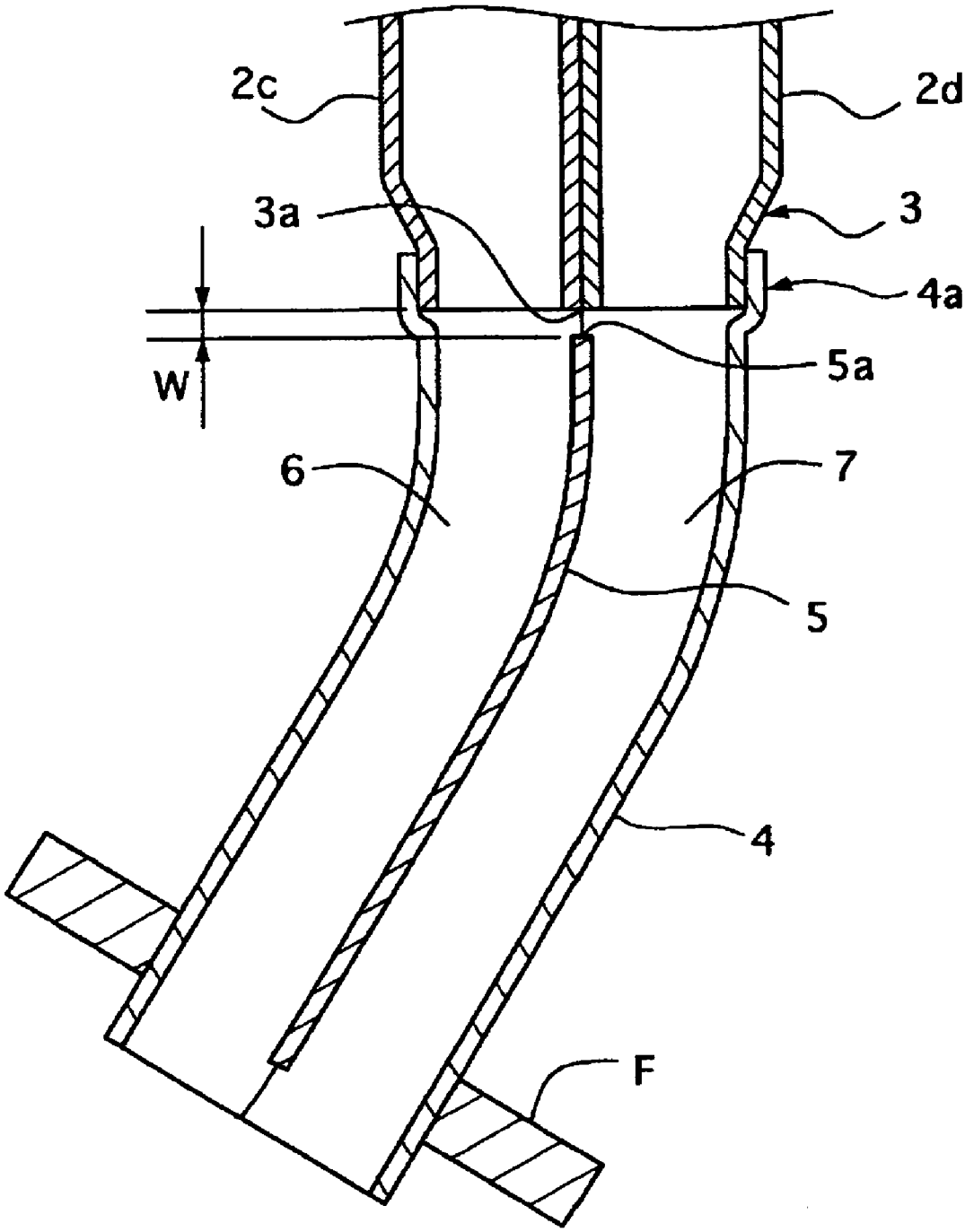
FIG. 3 is an enlarged cross-sectional view taken along the line S3-S3 in FIG. 1.

Furthermore, as shown in FIG. 3, a clearance W having a predetermined distance is formed between an upstream side end portion 5*a* of the partition plate 5 and an end portion 3*a* of the collecting section 3 so that a relative displacement of the partition plate 5 and the collecting section 3 due to thermal expansion can be tolerated.

Incidentally, to the downstream side of the joint tube member 4, a flange F for connection to a front exhaust tube P, including a catalytic converter, not shown, is externally engaged and fixed.

Figure 4:
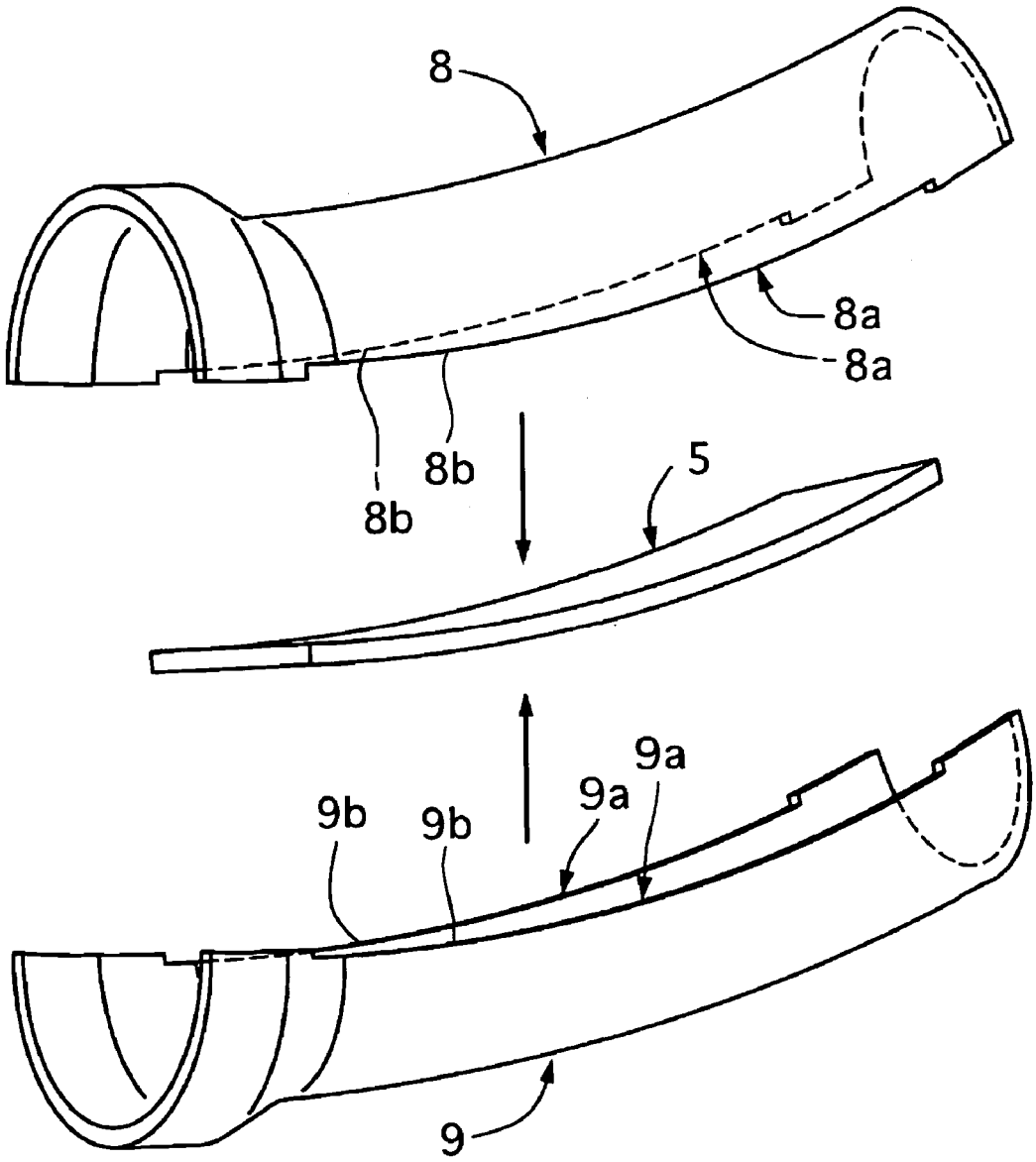
FIG. 4 is an exploded perspective view of the joint tube member shown in FIGS. 1 to 3 before assembling.
Figure 5:
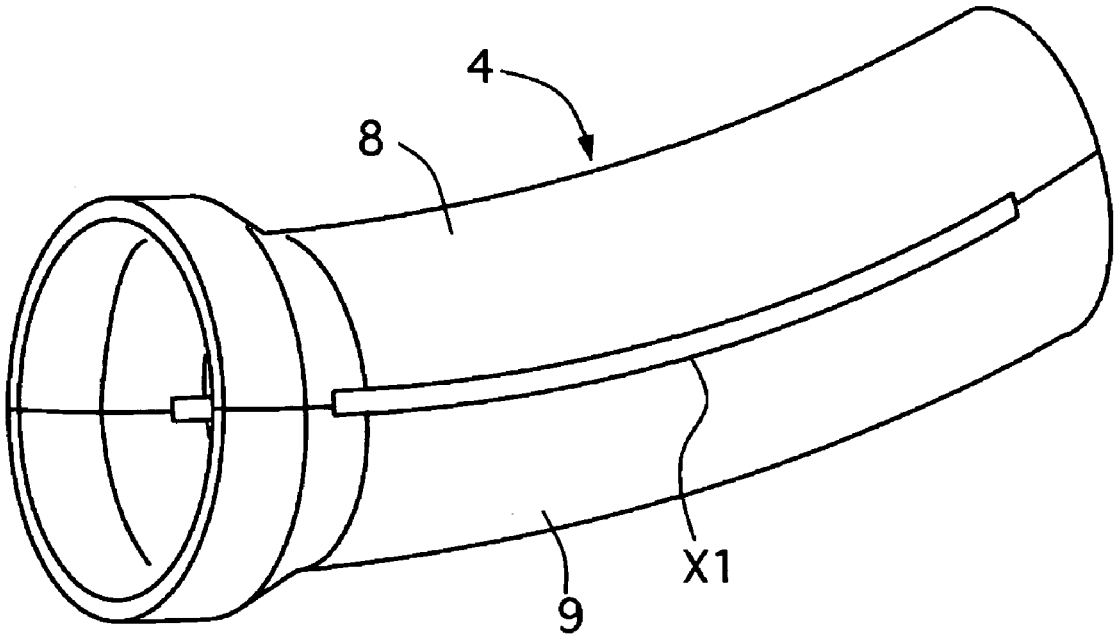
FIG. 5 is a perspective view of the joint tube member after assembling.

As shown in FIG. 4 and FIG. 5, the joint tube member 4 is constituted of an upper joint part 8, a lower joint part 9, and a partition plate 5 arranged between the joint parts 8 and 9. One of the upper joint part 8 and the lower joint part 9 corresponds to a first joint part of the present invention, while the other of the upper joint part 8 and the lower joint part 9 corresponds to a second joint part of the present invention.

The upper joint part 8 and the lower joint part 9 are each formed in a semi-cylindrical shape, and on both end portions thereof, joining portions 8*a* and 9*a* are formed extending along the longitudinal direction of the joint parts 8 and 9, respectively. On both the joining portions 8*a* and 9*a*, cut-out grooves 8*b* and 9*b* are formed extending in the longitudinal direction, respectively. One of the joining portions 8*a* and 9*a* that is formed on the first joint part corresponds to first joining portions of the present invention, while the other of the joining portions 8*a* and 9*a* corresponds to second joining portions of the present invention.

Incidentally, the cut-out grooves 8*b* and 9*b* are each formed with a depth that is half the thickness of the partition plate 5 and with an overall length equal to the length of the partition plate 5 so as to receive the partition plate 5 between the grooves 8*b* and 9*b*.

Then, as shown in FIG. 5, the upper joint part 8 and the lower joint part 9 are joined so that the partition plate 5 is sandwiched and fixed by the respective cut-out grooves 8*b* and 9*b*, and in this state, welding X1 is performed along the joining portions 8*a* and 9*a* of the upper joint part 8 and the lower joint part 9 to thereby form the joint tube member 4.

At this time, the partition plate 5 is in a state of being positioned by engaging with the cut-out grooves 8*b* and 9*b*, so that a positional displacement may not occur while performing welding, and thus the partition plate 5 can be easily and precisely fixed to the joint tube member 4.

Figure 6A:
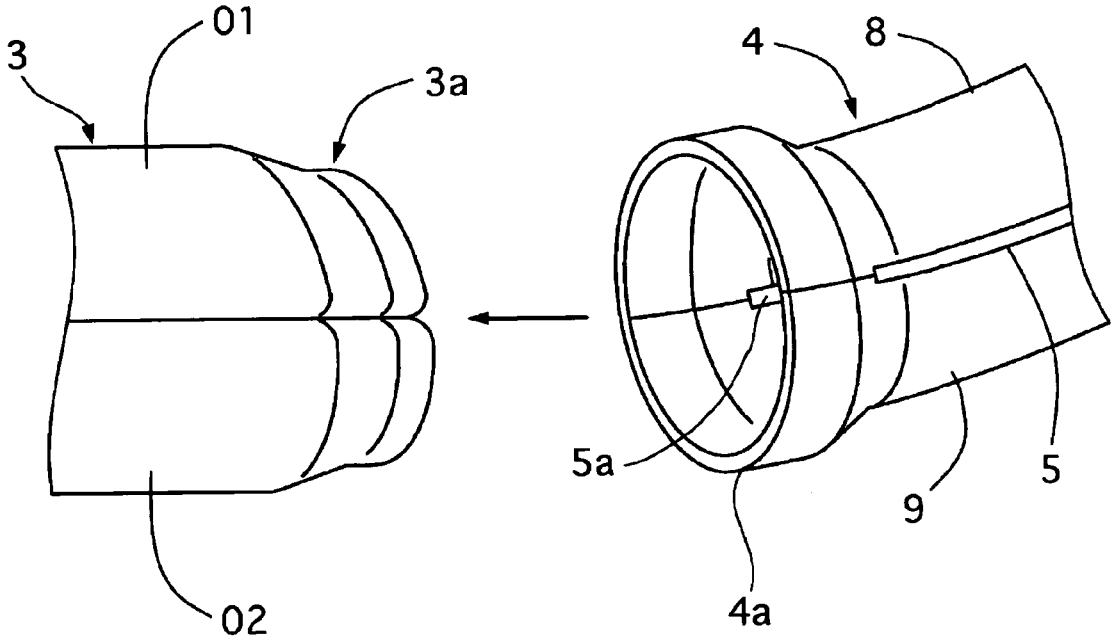
FIG. 6A is a perspective view describing a connection state of the joint tube member and a collecting section in a state that they are separated.
Figure 6B:
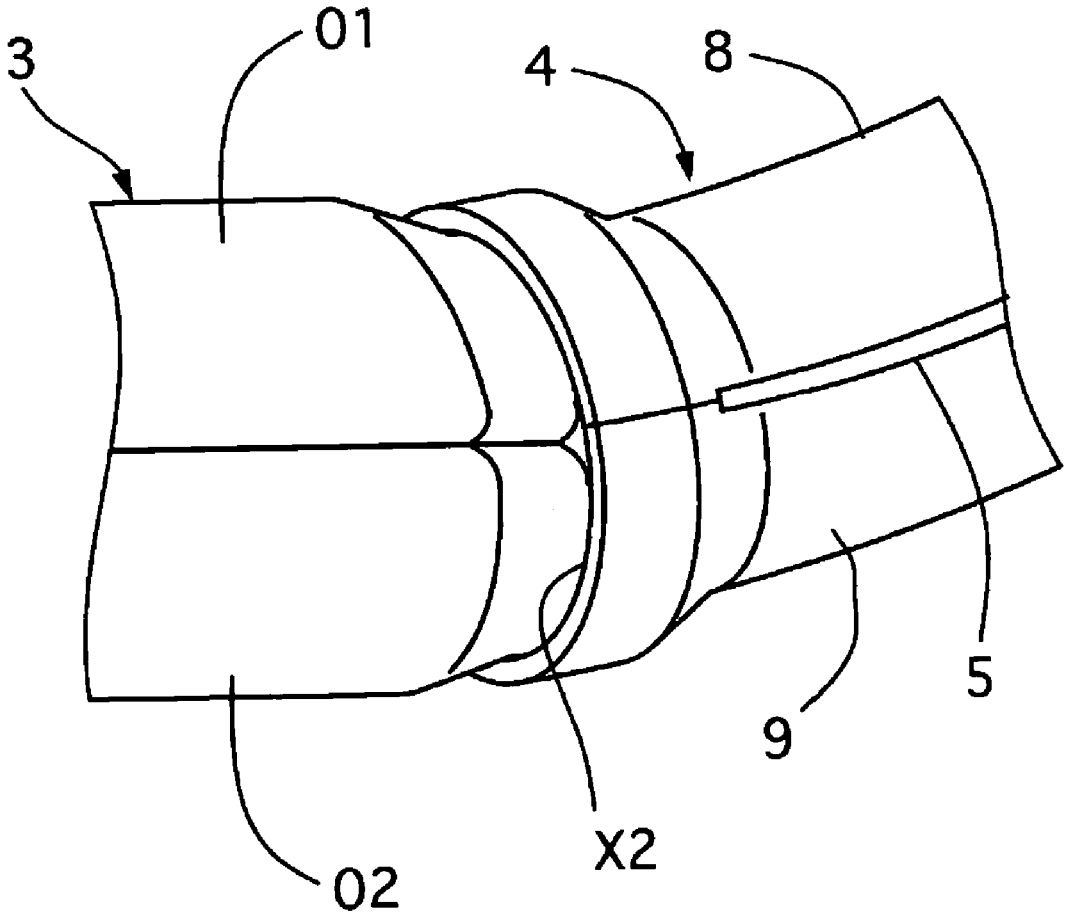
FIG. 6B is a perspective view describing a connection state of the joint tube member and the collecting section in a state that they are connected.

Then, as shown in FIG. 3 and FIGS. 6A and 6B, an end portion 3*a* of the collecting section 3 is inserted in an upstream side end portion 4*a* of the joint tube member 4 until reaching a position where a clearance W with a predetermined interval is formed between the upstream side end portion 5*a* of the partition plate 5 and the end portion 3*a* of the collecting section 3, and the upstream side end portion of the joint tube member 4 and the collecting section 3 are welded X2 so that the both of them are fixed.

At this time, upstream side end portions of both the joining portions 8*a* and 9*a* are in a state of abutting on each other, so that an unnecessary gap as in a conventional invention is not formed between the joining portions 8*a* and 9*a* and the collecting section 3, and thus the both of them can be welded by a welding chip with a small diameter. Consequently, the welding work becomes easy, and welding can be performed securely from outside including the partition plate 5. Therefore, there is no possibility that welding sputter enters inside the joint tube member 4.

Further, as described above, the partition plate 5 is precisely fixed with respect to the joint tube member 4, so that the clearance W in each product does not vary. Accordingly, a relative displacement which occurs when the collecting section 3 and the joint tube member 4 thermally expand can be surely tolerated.

Therefore, the clearance W can be minimized while tolerating the relative displacement due to thermal expansion, so that exhaust gas interference outputted from the exhaust manifold 1 can be prevented favorably and occurrence of noise can be prevented also.

In the foregoing, this embodiment has been described, but the present invention is not limited to the above-described embodiment. The present invention includes any change of design in the range not departing from the gist of the present invention.

Figure 7:
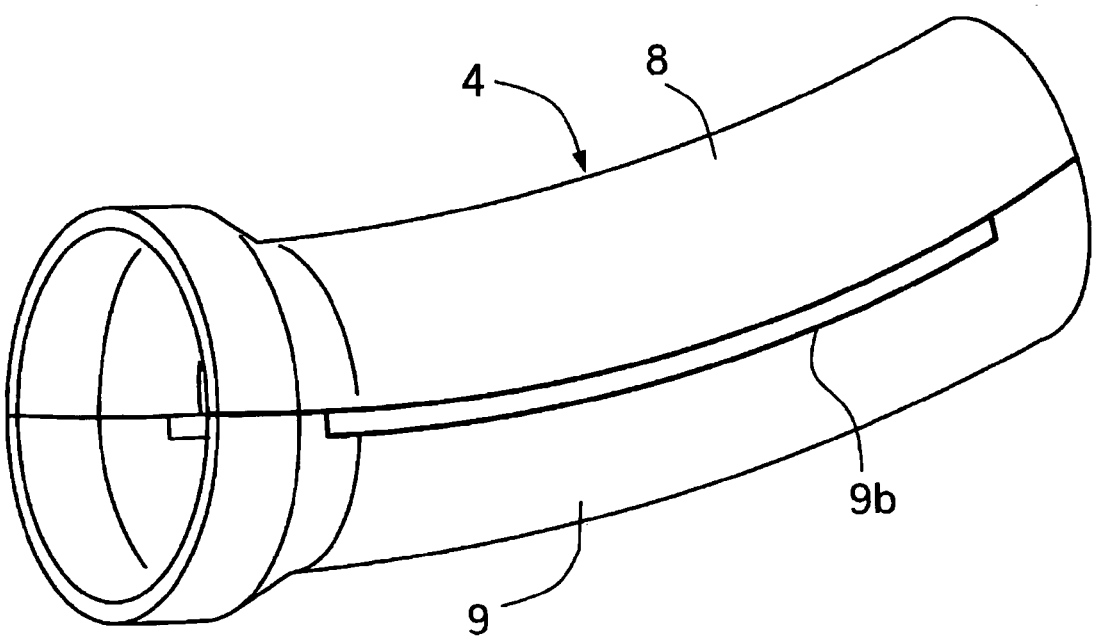
FIG. 7 is a perspective view of a joint tube member according to a second embodiment of the present invention.
Figure 8:
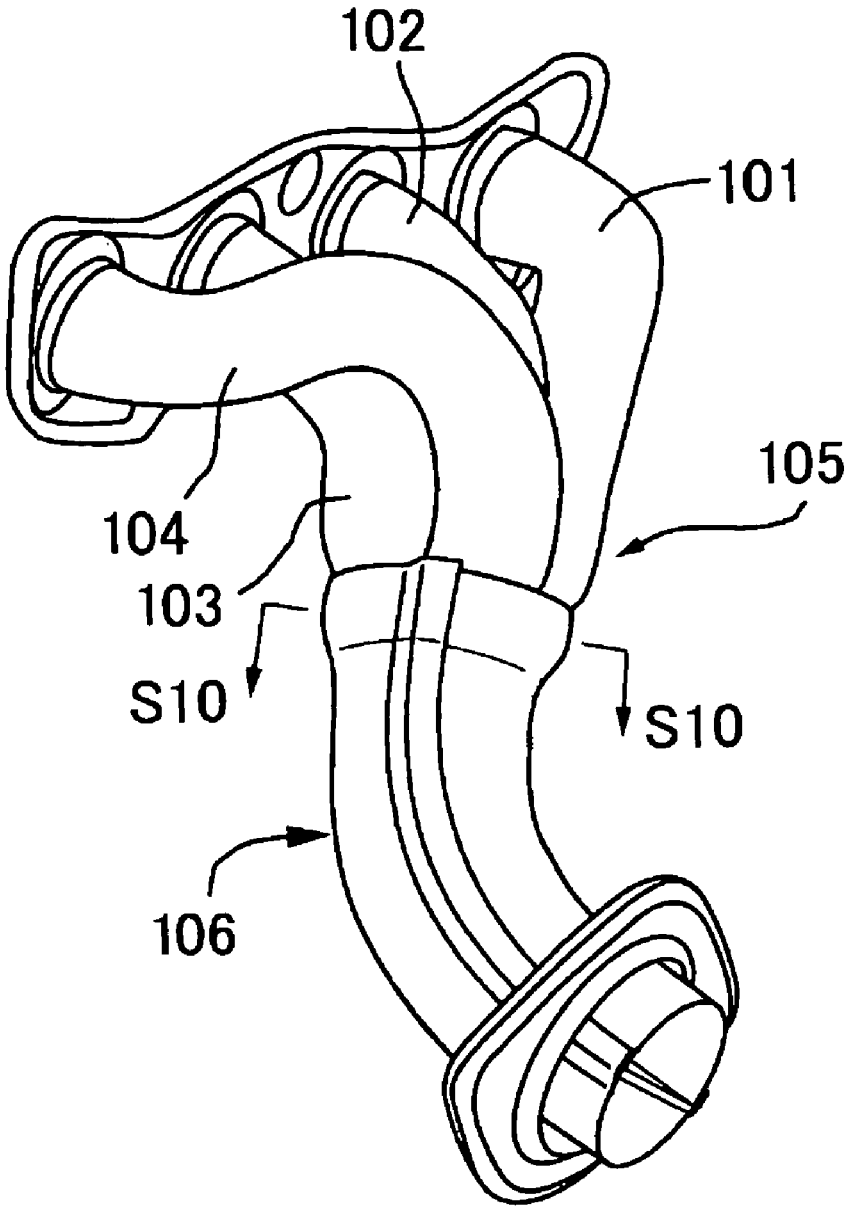
FIG. 8 PRIOR ART
FIG. 8 is a perspective view of a conventional exhaust system that includes an exhaust manifold, an exhaust pipe, and a joint tube member.
Figure 9A:
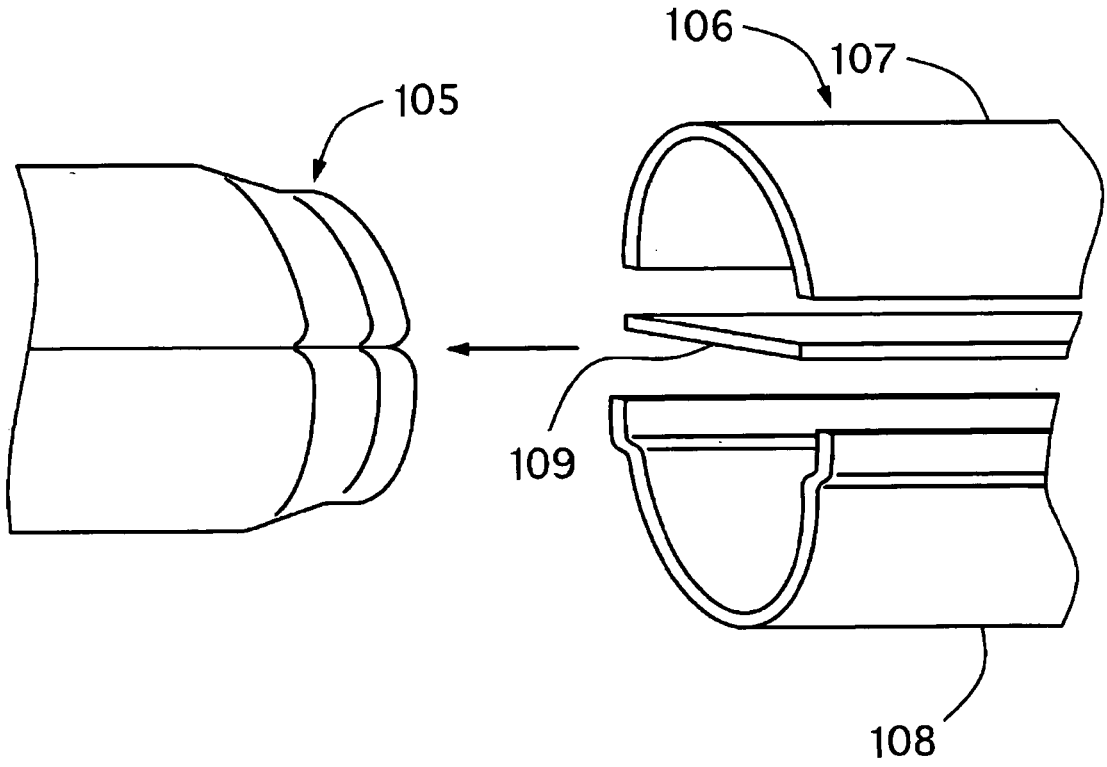
FIG. 9A PRIOR ART
FIG. 9A is a perspective view describing a connection state of the conventional joint tube member and a collecting section of the exhaust manifold before assembling.
Figure 9B:
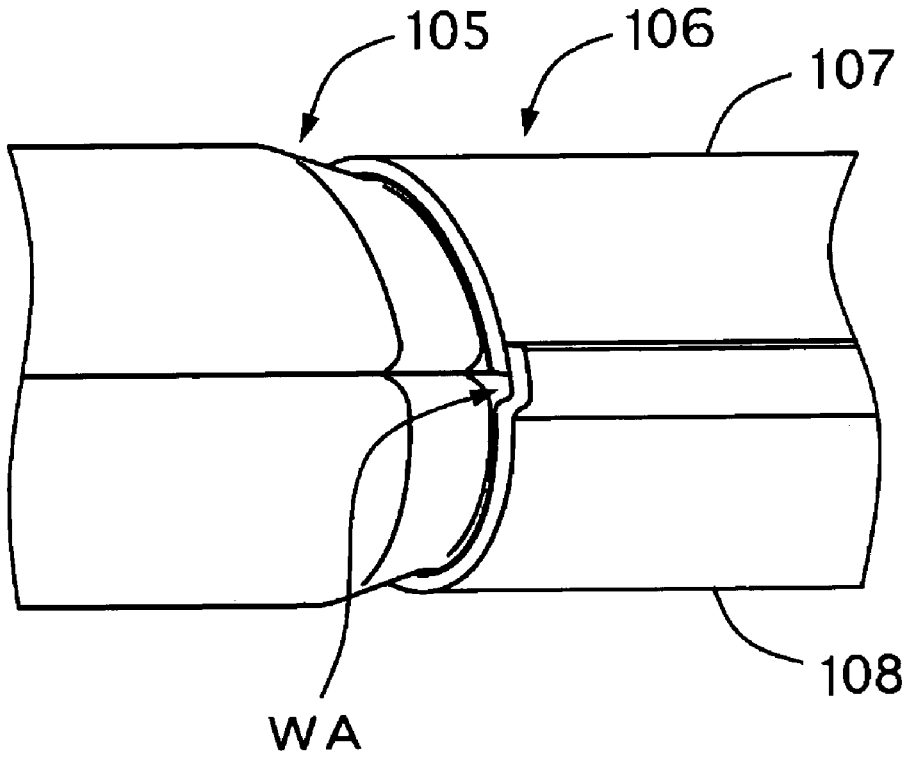
FIG. 9B PRIOR ART
FIG. 9B is a perspective view describing a connection state of the conventional joint tube member and the collecting section after assembling.
Figure 10:
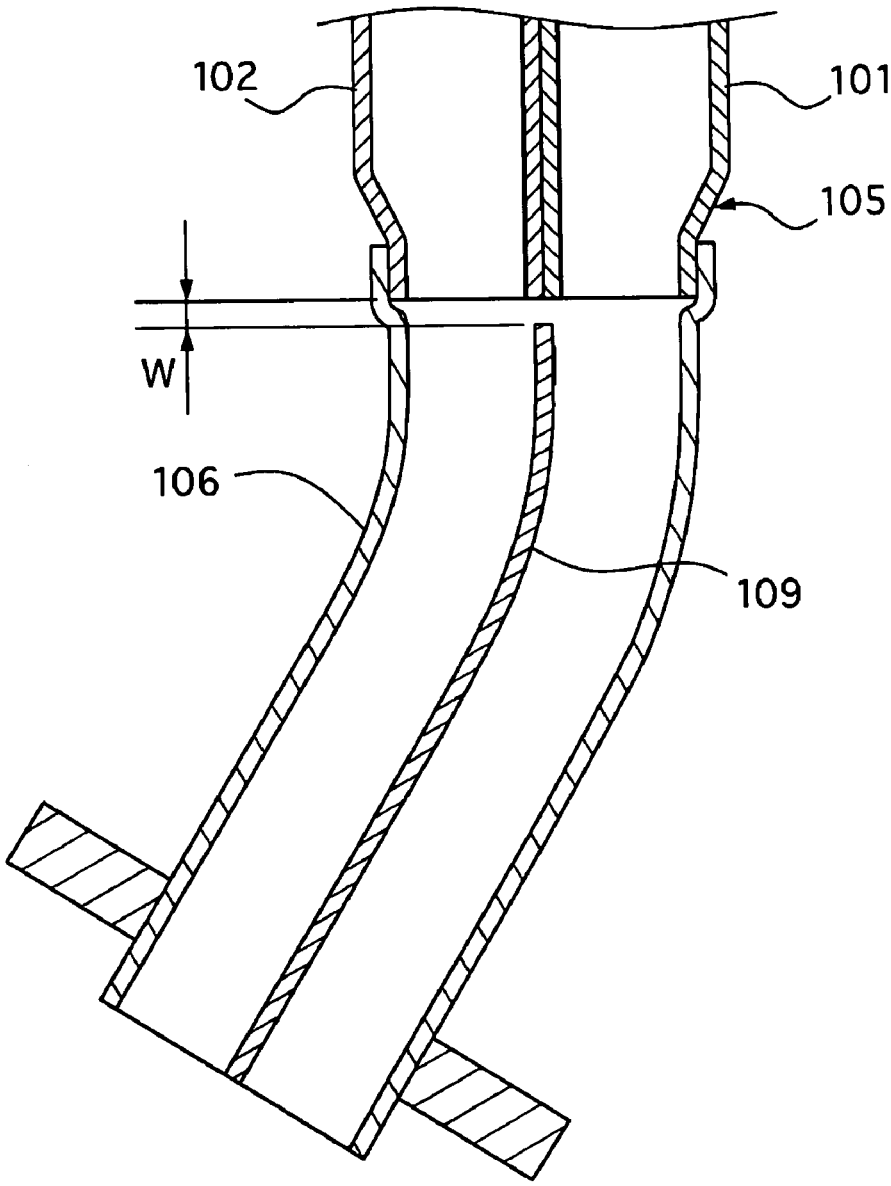
FIG. 10 PRIOR ART
FIG. 10 is a cross-sectional view taken along the line S10-S10 in FIG. 8.

For example, in this embodiment, the cut out portions 8*b*, 9*b* are formed on both the joining portions 8*a*, 9*a* of the upper joint part 8 and the lower joint part 9, but the structure may be change such that, as shown in FIG. 7, cut-out grooves each having a depth equal to the thickness of the partition plate 5 are formed on only either one of the upper joint part 8 and the lower joint part 9.

The entire contents of Japanese Patent Application No. 2003-403302 filed Dec. 2, 2003 is incorporated herein by reference.

What is claimed is:

1. An exhaust system for an engine comprising:

an exhaust manifold having a collecting section where pipes connected to respective cylinders of an engine are collected;

an exhaust pipe;

a cylindrical joint tube member having an upstream side end portion in which an end portion of the collecting section is inserted and fixed and a down stream side end portion in which an end portion of said exhaust pipe is inserted and fixed, said joint tube member being constituted of a first joint part and a second joint part having first joining portions and second joining portions to meet each other, respectively; and a partition plate which partitions the inside of said joint tube member, wherein a clearance is formed between the upstream side end portion of said partition plate and the end portion of the collecting section, wherein cut-out grooves are formed on at least one of the first and second joining portions of the first joint part and the second joint part, the cut-out grooves being blocked up at upstream side end portions and down stream side end portions of the first joint part and the second joint part, and wherein said partition plate is fixed to at least one of the first joint part and the second joint part in a state of being positioned by engaging with the cut-out grooves so that the partition plate is inserted into the cut-out grooves and an upper side end portion and a down stream side end portion of the partition plate are engaged with the cut-out grooves respectively.

2. The exhaust system for an engine according to claim 1, wherein upstream side end portions of both the first and second joining portions of the first joint part and the second joint part are fixed with each other in a state of abutting on each other.

3. The exhaust system for an engine according to claim 2, wherein the upstream side end portions of the first joint part and the second joint part are fixed with each other by welding.

4. The exhaust system for an engine according to claim 3, the first joint part and the second joint part are fixed with said partition plate by welding.

5. The exhaust system for an engine according to claim 1, the first joint part, the second joint part, and said partition plate are fixed with one another by welding.

* * * * *